US005772534A

United States Patent [19]

Dudley

[11] Patent Number: 5,772,534

[45] Date of Patent: Jun. 30, 1998

[54] SATELLITE ENHANCED GOLF INFORMATION SYSTEM

[76] Inventor: Douglas P. Dudley, 2916 Blakely Dr., Orlando, Fla. 32835-6141

[21] Appl. No.: 858,816

[22] Filed: May 19, 1997

Related U.S. Application Data

[63] Continuation of Ser. No. 240,983, May 11, 1994, abandoned, which is a continuation-in-part of Ser. No. 942,343, Sep. 9, 1992, Pat. No. 5,326,095.

[51] Int. Cl.[6] ..... A63B 57/00

[52] U.S. Cl. ..... 473/407; 473/131

[58] Field of Search ..... 473/131, 407, 473/409; 342/357, 457, 458; 364/444.1, 448, 449.1, 460, 410

[56] References Cited

U.S. PATENT DOCUMENTS

| | | | |
|---|---|---|---|
| 3,786,411 | 1/1974 | Kurauchi et l. . | |
| 3,868,692 | 2/1975 | Woodard et al. . | |
| 4,027,840 | 6/1977 | Blair . | |
| 4,156,873 | 5/1979 | Moore . | |
| 4,297,701 | 10/1981 | Henriques | 343/6.5 LC |
| 4,303,243 | 12/1981 | Wolfe . | |
| 4,419,655 | 12/1983 | May . | |
| 4,480,310 | 10/1984 | Alvarez . | |
| 4,656,476 | 4/1987 | Tavtigian . | |
| 4,698,781 | 10/1987 | Cockerell, Jr. . | |
| 4,702,342 | 10/1987 | Hale | 180/333 |
| 4,819,174 | 4/1989 | Furuno et al. . | |
| 4,863,123 | 9/1989 | Bernard et al. . | |
| 4,926,161 | 5/1990 | Cupp | 340/572 |
| 5,097,416 | 3/1992 | Matthews . | |
| 5,319,548 | 6/1994 | Germain | 273/32 R |
| 5,364,093 | 11/1994 | Huston et al. | 273/32 H |
| 5,434,789 | 7/1995 | Fraker et al. | 273/32 H |
| 5,438,518 | 8/1995 | Bianco et al. | 273/32 H |
| 5,469,175 | 11/1995 | Boman | 342/357 |
| 5,507,485 | 4/1996 | Fisher | 364/410 |
| 5,524,081 | 6/1996 | Paul | 364/460 |

FOREIGN PATENT DOCUMENTS

| | | | |
|---|---|---|---|
| 3501033A | 7/1986 | Germany . | |
| 2178210 | 2/1987 | United Kingdom . | |
| 2249202 | 4/1992 | United Kingdom | 273/32 H |
| 93/12439 | 6/1993 | WIPO | 273/32 H |
| WO9520168 | 7/1995 | WIPO . | |

OTHER PUBLICATIONS

*How to Select GPS Receivers,* West Marine 1994 Master Catalog (pp. 6, 7, 8, 12, 19).

*Primary Examiner*—Jessica Harrison
*Assistant Examiner*—Mark A. Sager
*Attorney, Agent, or Firm*—Harness Dickey & Pierce, P.L.C.

[57] ABSTRACT

A golf information system which provides for automatic detection of a golf cart position on a golf course by either a golfer on the cart or personnel in a golf course clubhouse. In one embodiment, a differential global positioning satellite receiver (DGPS) is utilized to detect a golf cart position and the detected position is compared with a digital data map where it is further transmitted to a golf cart display as well as to a clubhouse display, either automatically in a timed manner, or upon prompting by a golfer or clubhouse personnel. The system can be further used to send speed of play messages to a golfer from a clubhouse in order to speed up play, and can also be used to send emergency and acknowledgement signals from a golfer to a clubhouse in response to emergencies or messages displayed to the golfer. Furthermore, advertizing messages can be displayed to a golfer from a clubhouse in response to clubhouse initiated signaling.

20 Claims, 3 Drawing Sheets

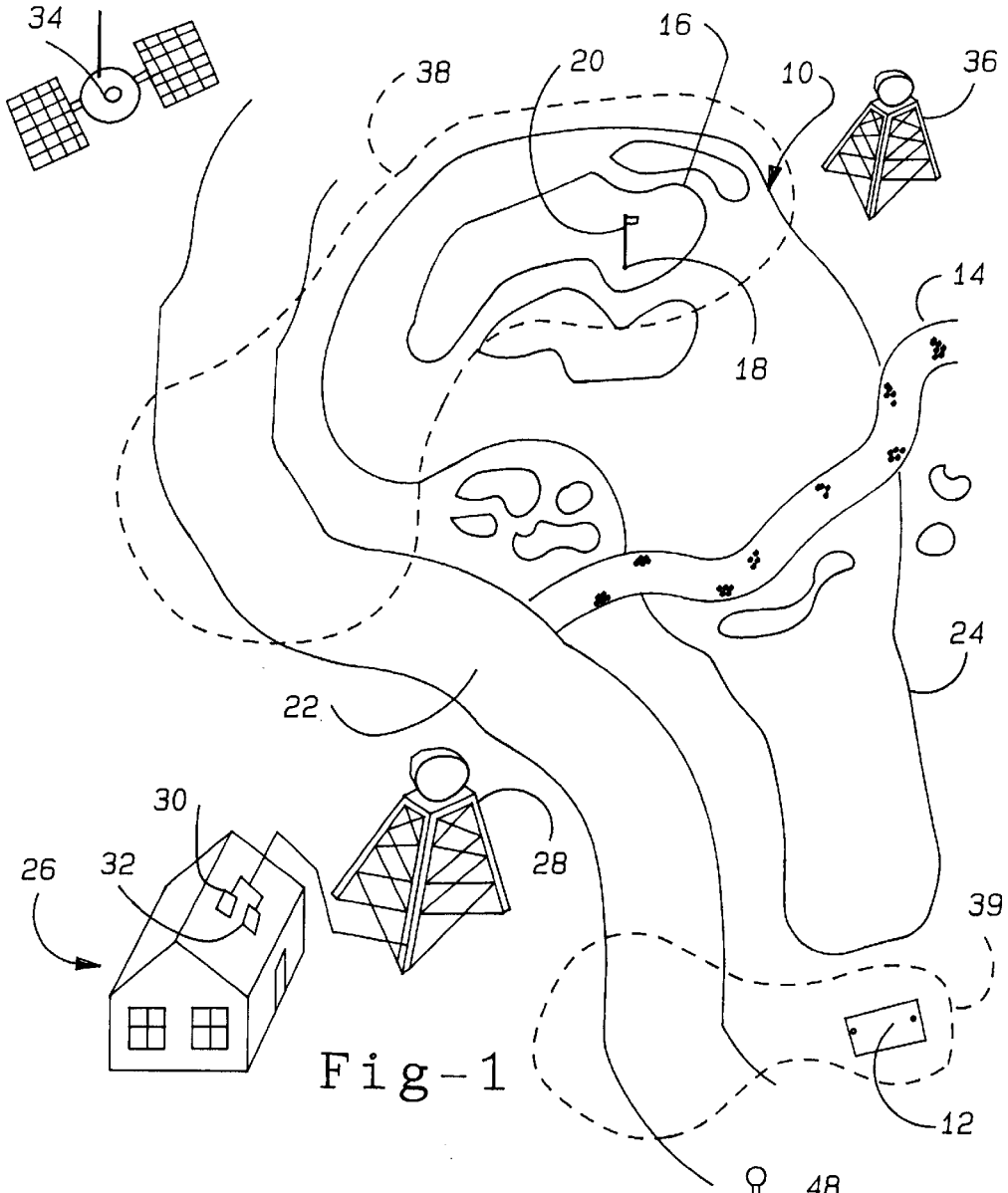
Fig-1
Fig-2
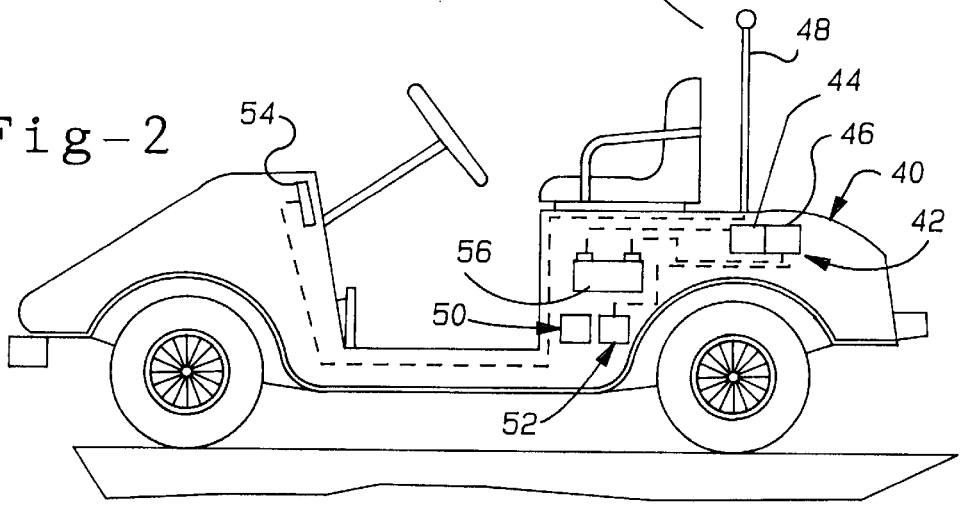

SATELLITE ENHANCED GOLF INFORMATION SYSTEM

CROSS-REFERENCE TO RELATED APPLICATION

This application is a continuation of application Ser. No. 08/240,983, filed May 11, 1994, now abandoned which is a continuation-in-part of application Ser. No.: 07/942,343, filed Sep. 9, 1992, now U.S. Pat. No. 5,326,095.

FIELD OF THE INVENTION

This invention relates to a system for providing position information for a golfer at various locations on a golf course, and more specifically to a system for receiving accurate position and play information. Variations include provision for a proximity detector which compares position information with stored waypoint data to access present hole position of a golfer on a course, a version which bi-directionally communicates between a golfer, preferably a golf cart, and a clubhouse, and a version which displays accurate golfer position to clubhouse personnel on a cartographic digital map display.

BACKGROUND OF THE INVENTION

The game of golf has endured through the years as a test of man's subtle coordination. Powerful men must restrain their strength in favor of timing, touch, and strategy. Variations in a golfer's swing, body alignment, grip, and tempo combine with wind, weather, trees, hills, sand and water to make golfing consistency an elusive goal.

Professional golfers know the importance of eliminating as many variables from the game as possible in order to improve their scores. They use precision weighted clubs and new balls without scars or ovality. They practice their club swing for hours striving to create a consistent or "grooved" swing. When the professionals reach a tournament course, they carefully study the tees, greens and hazards to plan their game strategy. One of the key aspects of strategy is knowing yardages from various points on the course to the green, and yardages to various hazards, such as water or sand traps. The yardage information enables the golfer to plan ball placement strategy and select the proper clubs for given distances. The luxury of inspecting and carefully planning golf strategy is not afforded the amateur golfer, even though they are just as concerned with knowing yardage information to the greens or hazards. The amateur cannot spend the time necessary to evaluate their ball positions accurately since play would become extremely slow and many courses do not have even the most rudimentary yardage references, such as the markers often used to designate a position 150 yards from the center of green.

Various mechanized approaches toward determining the yardage to various points or hazards are presently known. Examples of such systems include optical rangefinders which is trained on a target such as the pin flag and calculates the exact distance through triangulation. Other approaches using radio frequency communication technology are also known for measuring distance to a target. However, typically such devices are "active" devices in that they require a golfer to take some special steps each time yardage information is needed which would slow down play, and would likely be viewed as unfair and awkward to other players. Moreover, such devices do not find distances to other significant course landmarks such as sand traps or water hazards, or features hidden from view. Therefore, an improved device is needed for obtaining positional signals which are compared with stored positions and outputted to a golfer.

Additionally, the game of golf has evolved through the years from a game where players covered a course on foot while either carrying their clubs or towing their clubs on a hand held cart to a game where most players ride golf carts from shot to shot and hole to hole. As popularity of the game has increased and the number of players riding golf carts has likewise increased, the time of play has dramatically decreased, particularly due to use of golf carts. With each stop, a player must mount and demount from his cart which increases the time of play. Furthermore, players are typically paired together on a cart which means the cart must transit back and forth between both player's shots which greatly increases the distance an individual cart must travel. As a result, it has become necessary to monitor the position of golf carts on a course and furthermore to utilize employees, called "rangers", who scout a course for golf carts which are slowing down play in order to intercept them and encourage the players to accelerate their rate of play. However, use of rangers is expensive, inefficient, and disruptive. An employee can only monitor one position on a golf course at a time, and the presence of too many employees can produce an unwelcome golfing environment for most players. Furthermore, slow play on golf courses is generally caused by a handful of players who slow down play for the players following behind them. By monitoring the speed of play of all golf carts on a course, the information can be used to target slow golf carts in order to accelerate their play. As a result, a golf course can be more efficiently utilized which increases income on the course and makes play for all players more pleasurable and efficient.

Various approaches have been taken to monitor a position on a golf course, including radio frequency transmitters and receivers which function to perform radio location of a vehicle with respect to a plurality of transmitter antennas. Alternatively, location transmitters have been provided adjacent corresponding golf holes in a golf course which transmit a location signal to a golf cart based receiver in order to determine the length a golfer is taking to play a particular hole. However, such systems do not accurately determine position of a golf cart on a course while it is being played over its entire surface, and furthermore can not provide position and bearing information to a golfer in conjunction with speed of play information. Furthermore, improvements are needed for bidirectional exchange of such information between a golf cart and a clubhouse for interactively monitoring speed of play and transmitting warnings and messages between a player and a clubhouse, and additionally for detecting emergency conditions on a course. Additionally, previous attempts at monitoring golf cart position on a course have failed to accurately detect the golf cart's position relative to a hole being played, for example, when a ball is inaccurately played and it strays into another hole's playing area it causes confusion for the monitoring system when it can not distinguish which present hole is being played by a golfer.

Therefore, a need has arisen for a system which provides general golf information and further provides positional and locational information to a golfer on a course and improves speed of play monitoring and signaling between a golf cart and a golf clubhouse which automatically monitors a golfer's speed of play and notifies the golf course personnel and golfer of slow play while further providing for additional information which a golfer can use in determining position on a course.

Further objects, features and advantages of the invention will become apparent from a consideration of the following description and the appended claims when taken in connection with the accompanying drawings.

SUMMARY OF THE INVENTION

Pursuant to this invention, a golf cart information system provides accurate positional information to a golfer on a golf course with a global positioning satellite receiver which outputs a position signal which is compared and correlated with memorized positions and then displayed to a golfer. Alternatively, a golf cart information system provides for bidirectional exchange of information between a golf cart and a home station, such as a clubhouse, which utilizes a global positioning satellite receiver mounted on a golf cart for receiving earth orbiting satellite signals in order to determine global position with respect to a golf course, and preferably further includes radio-navigation differential beacon receiver information which operates to monitor and receive radio-navigation signals from a land-based signal transmitter in order to detect and base position of the golf cart. In the case where global position information is supplemented with radio-navigation differential beacon receiver information, an error correction factor is obtained for the global positioning satellite signal which is used to correct errors caused by selective availability (SA) which is an intentional degradation of non-military global positioning satellite signal accuracy as imparted by the Department of Defense. In the case where global positioning satellite signals are available to a golfer which do not contain selective availability, a standard global positioning satellite receiver can be incorporated in this system for receiving accurate positional information of a golf cart on a golf course. However, where global positioning satellite signals are only available with selective availability, incorporation of the differential beacon receiver, or radio-navigation differential beacon receiver, is utilized to perform the error correction for the global positioning satellite which essentially obviates selective availability and provides an accurate positional fix of a golf cart on a golf course.

Furthermore, a golf cart based transmitter is coupled to the global positioning satellite receiver and differential beacon receiver which digitally encodes and transmits the error corrected or clean satellite signal detailing present golf cart position, in conjunction with a time clock which marks the present time, and a golf cart identification label which identifies a golf cart, the time a fix was taken and the fix with respect to a course. Likewise, a receiver is provided at a home station, preferably a clubhouse, which receives the digital encoded position signal for monitoring a golf carts position on a course. Preferably, a golf cart also has the capability to transmit and receive signals from the clubhouse, and likewise, the clubhouse also has the ability to transmit and receive signals to the golf cart.

Additional benefits of the system are provided wherein a golf course employee can send a status signal to a golf cart which notifies a golfer of slow play, prompting the golfer to speed up play or terminate the game. Such signal can be produced automatically upon automatic prompting which intermittently evaluates the position of all golf carts on a course. Additionally, a global positioning satellite system receiver can be provided with waypoints which detect proximity of a cart to a particular hole on a course such that proximity to the waypoint triggers the car to send a positional signal to a clubhouse notifying the clubhouse of the golf cart's position on a course. Likewise, such a waypoint trigger can be used to initiate play on a new hole and green, as well as termination of play on a particular hole by providing a waypoint which detects proximity to a hole at the end of its play. Such a system eliminates erroneous detection of a golf cart on the wrong golf hole.

Further additional benefits are provided wherein additional warnings can be transmitted from a clubhouse to a cart where they are displayed, for example, in addition to warning of slow play, warnings which indicate play too close to a particular green, or which indicate limited access areas which prohibit access by carts, as well as hazardous weather conditions warranting the special attention of a golf cart driver, for example, lightning. Furthermore, warnings already issued to a particular cart can be listed at home base, namely, in the clubhouse, for monitoring status of a golfer and the warnings issued thereto. Additionally, a golf cart with such a system can be provided with an emergency signaling system, for example a button, which when pushed by a golfer either signals an emergency or medical emergency condition, or when pushed in response to a home base prompting acknowledges a message received by a golfer. Further additional features include incorporation of such a system on a motorized golf bag which transmits such information in an automatic mode between the golf bag carrying cart and the home base.

Further objects, features and advantages of the invention will become apparent from a consideration of the following description and the appended claims when taken in connection with the accompanying drawings.

BRIEF DESCRIPTION OF THE DRAWINGS

FIG. 1 is a plan view of an illustrative golf course hole incorporating elements of the golf information system according to a first embodiment of this invention;

FIG. 2 is a schematic diagram of a golf cart incorporating elements of the golf information system in accordance with the first embodiment of this invention and showing a global positioning satellite receiver and a differential beacon receiver in relation to the golf cart;

DETAILED DESCRIPTION OF THE PREFERRED EMBODIMENT

Figure 3:
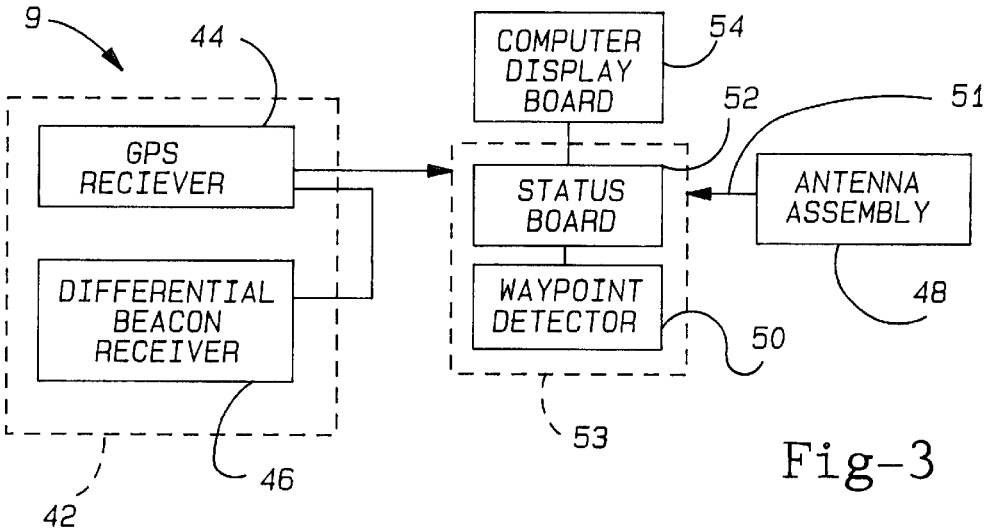
FIG. 3 is an electrical schematic diagram showing the functional subsystems of the global positioning satellite receiver and differential beacon receiver used with the golf cart information system of the first embodiment of this invention, and carried by a golf cart.

With reference to FIG. 1, a representative golf course hole generally designated by reference numeral 10 is shown with a tee area 12, creek 14, and a green 16 having a cup 18 which supports a flag or pin 20. A designated golf cart path 22 is provided on the left-hand side of a fairway 24 on which a golf cart preferably travels while a golfer plays a round of golf. A clubhouse 26 is further provided with a transmitting and receiving antenna which is connected with a radio frequency receiver unit 30 and a radio frequency transmitter unit 32. Furthermore, a high altitude satellite 34 is also shown in FIG. 1, which is in earth orbit, such that its orbital parameters are known, wherein a global positioning satellite receiver receives a signal from the satellite to determine positional location on the earth. Likewise, a radio frequency transmitting antenna 36, preferably a land-sea radio navigation antenna as run by the Coast Guard branch of the United States Government, is shown for transmitting signals to a radio navigation receiver, in this case a differential beacon receiver, in order to calculate positional error produced by a global positioning satellite receiver which has been induced by selective availability in order to obtain extremely accurate error correction which leads to accurate position and velocity data from the DGPS system. A waypoint proximity region 38 is provided around a portion of the golf cart path 22 adjacent flag 20 such that presence of the golf cart within the region is used to determine end of play for a golf course hole which enhances a golf information system's ability to detect the presence of a particular golf cart within the golf course hole presently being played, even when play leads the golf cart into an adjacent hole as a result of a poorly played ball.

A description of the physical components and electronic systems of a golf information system according to the first embodiment of this invention will be made with reference to FIGS. 2–6. A description of the operation of the system will be provided following the physical description of the elements. FIG. 2 shows a golf cart 40 which carries a differential global positioning system (DGPS) receiver 42 for detecting golf cart position on a course. DGPS receiver 42 principally comprises a GPS receiver 44 and a differential beacon receiver 46 which are interconnected such that GPS receiver 44 receives a satellite fix from a satellite having selective availability and differential beacon receiver 46 receives radio and navigation signals to determine position relative to at least one transmitting antenna such that the differential error for the GPS receiver is calculated and corrected for in order to provide increased fix accuracy of a golf cart's position on a course. Both a GPS receiver 44 and compatible coupling differential beacon receiver 46 are commercially readily available which communicate together to perform enhanced fix accuracy as a DGPS receiver 42. Such systems are presently available from GARMIN INTERNATIONAL INC., located at 9875 Widmer Road, Lenexa Kans. As shown in FIG. 4, a differential GPS system is incorporated in the antenna system on the golf cart 40. Alternatively, where the United States Government has waived the intentional degradation of non-military GPS signal accuracy on behalf of the Department of Defense, thus eliminating selective availability, differential GPS is no longer needed, and a standard GPS receiver 44 would provide the requisite necessary additional information of a golf cart accurately positioned on a golf course.

With reference to FIG. 2, a golf cart 40 is provided with the DGPS receiver 42 in order to determine a golf cart's position. An antenna assembly 48 interconnects with the DGPS receiver 42 through a status board 52 which receives and stores additional information from the DGPS receiver 42, and a waypoint proximity detector 50 which detects proximity information of a golf cart adjacent a flag or pin 20, and furthermore provides display information to a computer and display board 54. A battery 56 drives the entire system electronics through the status board 52.

Figure 4:
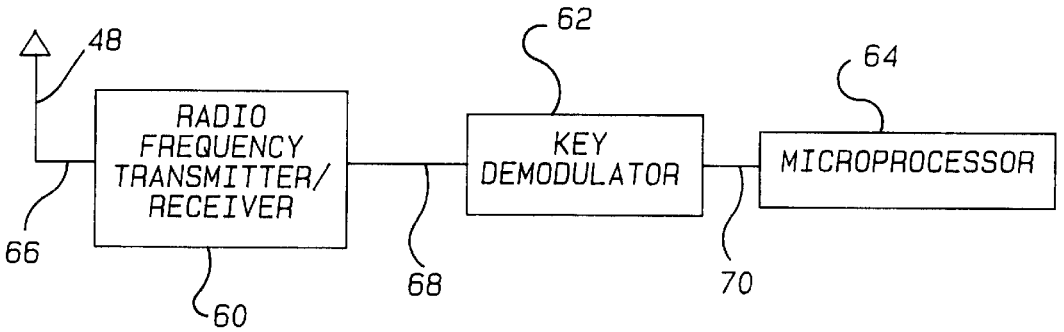
FIG. 4 is a block diagram of a radio frequency transmitter/receiver unit used upon the golf cart of the preferred embodiment of this invention for communicating with a clubhouse.

FIG. 3 further depicts the various elements of the golf cart information system 9. DGPS receiver 42 records positional information of a golf cart which is input into status board 52. Waypoint detector 50 compares this information with known course position information and locations which is digitally stored to determine the status of a golf cart on a course. Furthermore, the resulting information is fed to the computer and the display board 54 such that position and status information, as well as messages and prompt signals, can be detected by a golfer on the cart. Furthermore, radio frequency transmitter/receiver unit 58 provides for interactive monitoring of a golf cart's position on a course by personnel at clubhouse 26 through the transmitting and receiving antenna 28.

Figure 6:
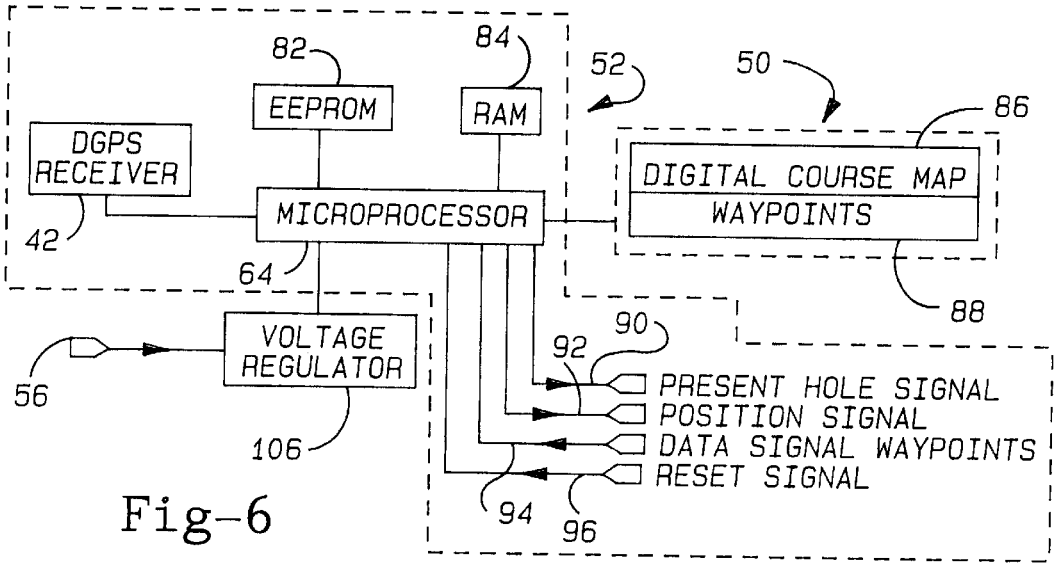
FIG. 6 is an electrical schematic diagram of the waypoint proximity detector found generally in FIG. 2.

Referring now to FIG. 4, there is shown details of the radio frequency transmitter/receiver unit 58 used in the preferred embodiment of this invention and containing the antenna 48 provided on the golf cart 40, a radio frequency transmitter and receiver 60, a key demodulator 62, and a micro-processor 64 (shown generally in FIG. 6 supra). Antenna 48 is coupled to the radio frequency transmitter/receiver 60 by bus 66 while the radio frequency transmitter/receiver 60 is coupled to the key demodulator 62 by bus 68. The output of the key demodulator 62 is coupled to the micro-processor 64 by bus 70.

In operation, signals are output from antenna 28 at the clubhouse 26 which are received by antenna 48 and then input to the radio frequency transmitter and receiver 60 by signals on bus 66. Thereafter, the received radio frequency signals are input into the key demodulator 62 by bus 68, where the received signal is demodulated thereby producing the original stream of data originally transmitted from the radio frequency transmitting unit 32 within the clubhouse 26. Demodulator 62 then impresses this data upon the bus 70 to the micro-processor 64. Micro-processor 64 then functions in conjunction with a micro-controller 72 and entities 82, 84, 98, 100, and 102, shown in FIGS. 6 and 7 in the aforementioned manner to receive and interpret the digital signal data originally received from the clubhouse antenna 28.

Figure 5:
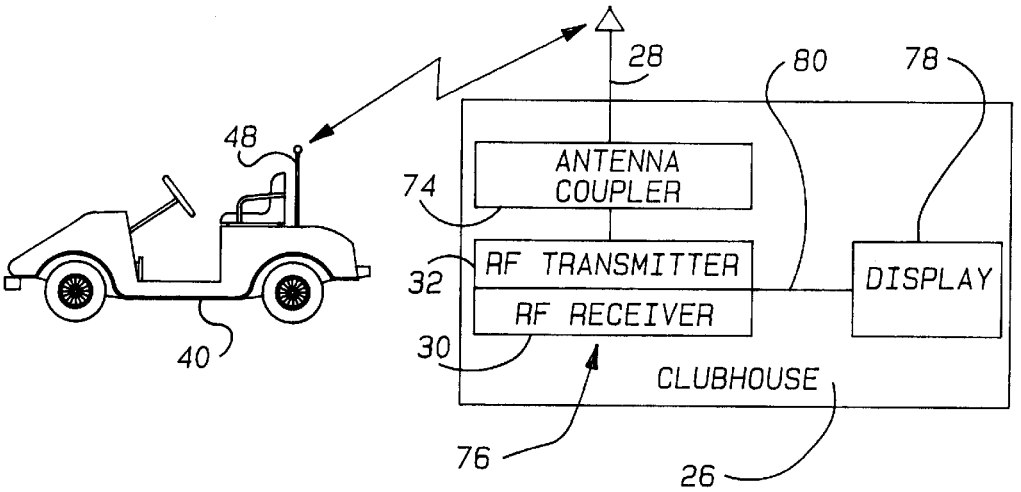
FIG. 5 is a block diagram of a radio frequency transmitter/receiver unit provided in a clubhouse for communicating with a golf cart.

Referring now to FIG. 5, there is shown a golf cart 40 in conjunction with a typical golf course clubhouse 26, in which a radio frequency transmitter/receiver unit 76 and a typical display (i.e., cathode ray tube) 78 are housed. Specifically, radio frequency transmitter/receiver 76 is coupled to antenna 28 by an antenna coupler 74 and is further coupled to display 78 by bus 80. In operation, the digital signature upon bus 51 which is stored on status board 52 as received from DGPS 44 and compared with waypoint detector 50 is sent by antenna 48 of golf cart 40 to antenna 28 which couples to receiver 32 within transmitter and receiver unit 76 which then places it upon bus 80 to the display 78. The receiver 32 would normally contain a key demodulator 62 as shown in FIG. 4 in order to reproduce this signature data from the radio frequency data. In this embodiment, the digital signature generator generates a golf cart signature in addition to the aforementioned distance signature upon status board 52 from DGPS 42 as well as current time data. Display 78 then visually displays the golf cart position information relative to golf cart 40 and the associated waypoint information which determines the hole presently being played by golfers on the cart as determined by waypoint detector 50 in conjunction with DGPS 42. In this way, the management of the typical golf course can determine where each of a plurality of golf carts 40 are located at any given time on the golf course and can, by observing the display 78 over a period of time, determine the approximate speed of play associated with users of golf cart 40. This could be used to potentially speed up the overall play upon a typical golf course. Furthermore, messages may also be transmitted to the golf cart 40 on a golf cart liquid crystal display 104 by micro-controller 72 if too much time has elapsed during play of a single golf hole 10. Furthermore, information can be transmitted to the display 104 indicating warnings or hazardous weather conditions, for example, lightning or tornados, as well as advertizing, and requests for the user to transmit acknowledgement of receipt of such a message.

The status board 52 and waypoint detector 50 are shown in detail in FIG. 6 and include micro-processor 64 having its operating system software stored on EEPROM 82 and RAM 84. Micro-processor 64 monitors and receives position information from DGPS 42. A voltage regulator 106 receives power from golf cart battery 56 and provides a filtered and controlled power supply for reading position information from the DGPS 42. As shown in FIG. 6, a number of data input and output signal lines are provided for micro-processor 64, including present hole signal 90 and position signal 92 which are outputted from micro-processor 64, and receive data signal 94 and reset signal 96 which are inputs. Operation of the DGPS 42 in response to signals from lines 90–96 will be described in greater detail below.

Figure 7:
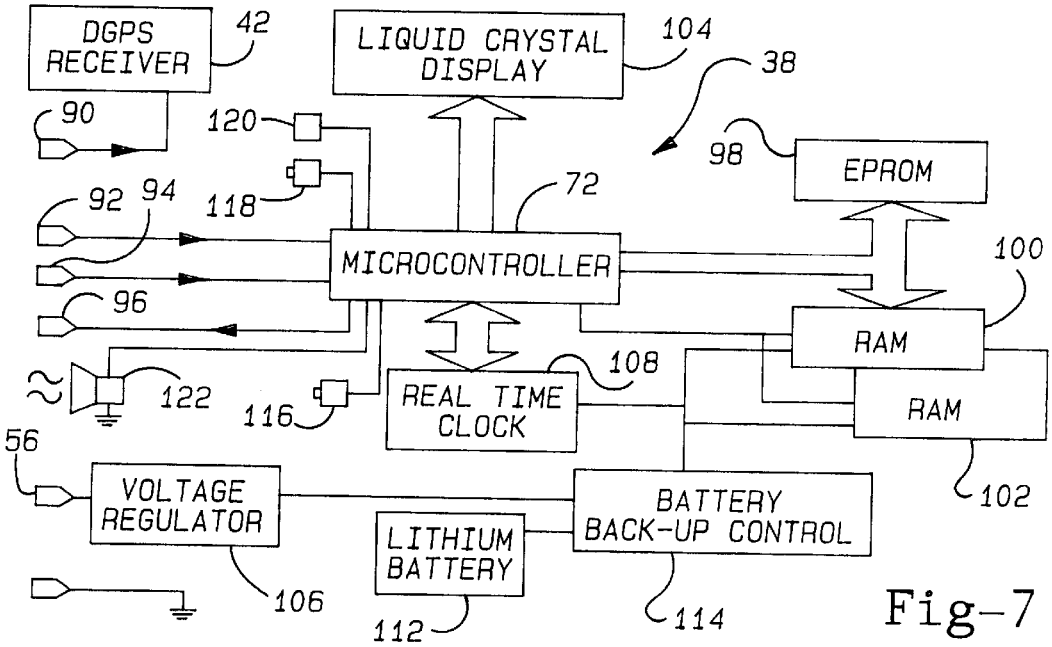
FIG. 7 is an electrical schematic diagram of the functional subsystems of the status board shown generally in FIGS. 2 and 3.

The functional components and subsystems of the computer and display board 54 are shown with reference to FIG. 7. Micro-controller 73 has its operating system stored on EEPROM 98 and several ram chips 100 and 102 are provided for data storage. A real time clock 108 provides a time-of-day reference and can be used for displaying a local time message to the golfer and/or timing the golfer's progress through the course. The power supply for computer and display board 54 is the golf cart battery 56 and also includes a voltage regulator 110. Lithium battery 112 and battery backup control 114 are provided to retain stored information upon interruption of power from golf cart battery 56. Micro-controller 72 drives display 104 which is preferably a liquid crystal-type since they are easily read in bright sunlight. The position transmit and receive signals 92 and 94 are inputted into micro-controller 72, and reset signal 96 is outputted. The present hole signal 90 is provided to determine the present hole being played by golfers on a specific identified golf cart.

Normally, signal 90 is operable to receive update signals which indicate proximity to a preselected waypoint from waypoint detector 50 which indicates a change in status of the present hole being played by a golfer on cart 40 such that the hole presently being played is identified by a predefined boundary about a waypoint, for example a circle having a defined radius, which is identified by the DGPS 42 position point such that it is compared by micro-processor 64 with a pre-selected waypoint 88. For example, a green-waypoint proximity region 38 can be provided about a hole 10 such that positioning of a cart adjacent a hole indicates end of play of that hole and the system is notified once the cart leaves the region to update the hole status to the next numerical increasing hole such that the present hole signal 90 is incrementally increased by unit one. Alternatively or additionally, a tee-waypoint proximity region 39 can be provided about a tee area 12 such that position of the cart adjacent the tee can be used to trigger start of a new hole, and once detected, the number of a hole being played can be "reset".

In one mode of operation, received data signal 94 is provided to receive updated waypoint and course change information as contained within digital course map 86 and waypoints 88. Normally, signal 94 is in an activated and ready state and only sends a signal to micro-processor 64 when a hole position on a course, or a desired waypoint has been changed by a course grounds keeper. The transmitted present hole signal 90 consists of the coded signal outputted from the DGPS 42 which has been processed and reformatted by a micro-processor 64.

Operation of the golf information system according the aforedescribed first embodiment of this invention will now be described in view of the above description. Since the high altitude satellite 34 and radio frequency transmitting antenna 36 are continuously operating, an accurate position of cart 40 is outputted to status board 52 as further detailed in FIG. 6. Preferably, due to the implementation of Selective Ability (SA) which degrades the accuracy of the satellite signal, DGPS 42 must be implemented in order to accurately obtain the cart's position. Alternatively, in the event selective availability is not implemented on the global positioning satellite signal, a standard GPS unit 44 can be utilized alone to obtain an accurate position of the golf cart 40 on a golf course. Furthermore, ordinary GPS can be implemented which will provide less accurate positional information. Micro-processor 64 receives such accurate position information continuously updating such information such that it is compared with a digital course map 86 in conjunction with information on the course hole presently being played as detected by waypoint 88 in order to provide information both to the golf cart operator via display 54, namely, liquid crystal display 104, as well as by a golf cart operator via receiving unit 30 in a clubhouse 26 on a clubhouse display 78. The software on the status board 52 compares the position information from the DGPS 42, or GPS (44), with the digital course map information in order to provide a golf cart position with respect to a particular hole, namely, in relation to a green and hole, or a tee area 12. Such information provides relative positional information of the golf cart with respect to the golf course. Alternatively, global position of a golf cart with respect to the earth can be compared to positional information of the golf course in determining position of a golf cart on a golf course. Furthermore, speed of a golf cart on a golf course can be monitored and detected by differentially measuring and comparing the position information from the DGPS 42 over time, or alternatively, by monitoring velocity information output from a DGPS 42 which displays golf cart speed.

The signal outputted by the DGPS 42 is processed at micro-processor 66 and transmitted to micro-controller 72 which fetches a set of instructions from a look-up table contained in EEPROM processor 98 and/or RAM's 10 and 102. The signal from micro-processor 64 on line 92 is sent to micro-controller 72 in serial fashion, for example, as a twelve-bit word at 1,200 baud. Signals having larger binary digits, or words, could be used to discriminate larger chunks of data received from the DGPS.

Figure 8:
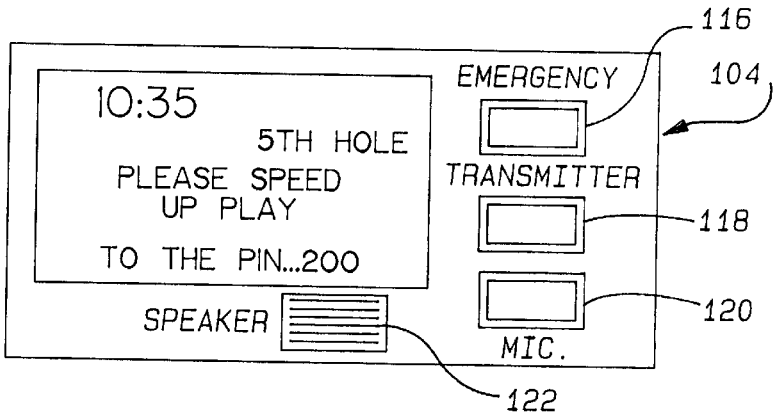
FIG. 8 presents an illustrative output of information for the golfer provided by the first embodiment of the system of FIG. 2.

FIG. 8 illustrates a representative output generated by a clubhouse transmitted message which informs a golf cart operator of a slow play condition, as well as displays present time, and position on a course, as well as present hole being played. Furthermore, distance to the pin is also displayed in a manner which could be utilized to further provide positional information of a golf cart on a course to a golfer. An emergency prompt button 116 is provided adjacent the liquid crystal display 104 in the computer and display board 54 which allows a golfer to signal an emergency on the course to a golf course employee in clubhouse 26. For example, a medical emergency requiring immediate action could be signaled by depressing the emergency button where an operator in the clubhouse can detect the golf cart's present position and can dispatch a course ranger immediately to respond to such emergency. Furthermore, a transmit button 118, or alternatively, a dual use of button 116, can be used to signal an acknowledgement of a message received from a clubhouse by a golfer on the golf cart 40. For example, upon transmission of a message to speed up play, a golfer can acknowledge receipt by depressing the transmit button 118. Furthermore, a microphone 120 and speaker 122 are further provided on the display board 54 for carrying out a conversation between the clubhouse and golf cart.

By using a digital course map 86 in conjunction with the DGPS position information, the size of memory necessary to monitor a golf carts position is minimized, and the reliability and speed of information transmission between the golf cart and clubhouse is enhanced, and modifications to the outputted information can be easily achieved by reprogramming out the digital course map 86 or the registered and stored waypoints 88 of selected positions on the golf course. Such digital course map systems, or cartographic map systems, are presently available for marine use from GARMIN INTERNATIONAL INC., located at 9875 Widmer Road, Lenexa, Kans. An example is the GPSMAP 220 by GARMIN which utilizes a GPS receiver with cartographic digitized maps, or charts, from Navionics located at 8 Pine Meadow Pl., Commack, N.Y. Alternatively, either the digital course map 86 and/or the waypoint analyzer 88 can be provided in the clubhouse such that precise positional information is transmitted from the golf cart through antenna 48 to the clubhouse antenna 28 where the information is compared with the digital course map information and waypoints to determine a golf carts position on the course, as well as a golf carts relative position to known waypoints on the course which further allows for protection of the present hole being played by a golfer on the cart.

In addition to the above features, the golf information system according to this first embodiment also provides the capability of several additional functions and features. In conjunction with the real time clock 108 as well as the waypoint information 88, micro-controller 72 can measure the elapsed time a golf cart has spent on a particular hole or has spent throughout a golf course such that the time of play for a particular hole or a segment of the course can be monitored. If the measured play is excessively slow, a prompting message can be automatically displayed to a golfer on display board 54 which may be further supplemented by an audible signal from an emitter, here speaker 122. The look-up table contained in EEPROM 98 and RAM's 100 and 102 for micro-controller 72 can also include advertizing messages which are activated by an operator or system in the clubhouse. The system can also contain a number of housekeeping functions. For example, an internal count can be made of the number of reading cycles by a particular golf cart to evaluate cart usage and a low battery signal could be outputted from the cart which alerts the operator of the necessity of maintaining the cart. Likewise, the number of warning signals displayed to a golf cart operator can be monitored both by the golf cart operator on display board 54 and display 78 in the clubhouse.

Another refinement for the subject golf information system, of this first embodiment, comprehends changes in repositioning a cup 18 on the surface of a green 16 which has the effect of changing the distance from the reference points provided in the digital course map 86. As shown in FIG. 1, a starting location for a given hole can be designated with waypoint information by the green waypoint proximity region 38 as well as, or alternatively by, the tee waypoint proximity region 39. Preferably, both regions are positioned adjacent the tee area 12 and green 16 or hole 10 in the location where a golf cart 40 will pass as a player begins or ends play on a particular hole. For example, the size of the region surrounding a definitive location of waypoint on the course is preprogrammed and determined based upon course and hole shape, size and ground surface area provided for a golf course to pass over. Such information is stored in EEPROM in waypoint 88 adjacent EEPROM stored information for digital course map 86. When the golf cart 40 is detected through DGPS 42 within such a waypoint defined region, knowledge about the location of the cart with respect to a hole is made available. For example, when a golf cart is detected in the tee region 39, it is known that the golf cart is beginning play on that particular hole. Likewise, as a golf cart enters the green region 38, it is known that the golf cart is completing play on that hole and about to begin play on the next subsequent hole. Preferably, the digital course map 86 can be updated from an operator within the clubhouse through transmitting unit 32 and data waypoint signal 94 with reset signal 96. In the case where a hole is slightly moved, the digital course map can be updated as well as the information for the respective green region 38. Furthermore, in the case where positional information is displayed on display board 54 to a golfer which indicates distance to a green and hole, the respective distances and positions on the course can be updated to display to a golfer, for example, the distance to a green.

It is to be understood that the invention is not limited to the exact construction illustrated and described above, but that various changes and modifications may be made without departing from the spirit and scope of the invention as defined in the following claims.

I claim:

1. A golf information system for providing a golfer with information regarding the distance to designated points on a golf course having a plurality of golf holes comprising:

a receiver moveable with said golfer having locating means for determining the position of said receiver on said golf course and microprocessing means for calculating distances from said position of said receiver to said designated points stored in a memory, said microprocessing means relaying said information to display means for displaying said information to said golfer regarding the distance to said designated points on said golf course relative to said receiver; and golf hole determination means for causing said display means to output said information related to one of said golf holes being played by said golfer wherein the golf course includes a plurality of golf hole identifying regions with at least one said hole identifying region associated with each said golf hole and at least two said hole identifying regions associated with one said golf hole, such that said position of said receiver is compared with said hole identifying regions by said microprocessing means to detect the presence of said receiver within a hole identifying region on said golf course in order to automatically establish a present golf hole being played by said golfer, wherein once said present golf hole is established said information is related to said designated points of said golf course associated with said present golf hole until a new golf hole is automatically established by detecting the presence of said receiver within another of said hole identifying regions.

2. A golf information system of claim 1 wherein said hole identifying regions include a region adjacent a tee box of one of said golf course holes to determine that said golfer is starting play on said present hole.

3. A golf information system of claim 1 wherein said hole identifying regions include a region adjacent a green of one of said golf course holes to determine that said golfer is completing play on said present hole.

4. A golf information system of claim 1 wherein said hole identifying regions are defined by the location of said golf information system relative to a waypoint on said golf course.

5. A golf information system of claim 1 wherein said golf information system further comprises transmitter means movable with said golfer for transmitting receiver position information to a remote location.

6. A golf information system of claim 5 wherein said remote location is a golf clubhouse microprocessor means for monitoring the positions of said golfers on said golf course.

7. A golf information system of claim 6 wherein said golf clubhouse microprocessor means is used for notifying said golfer of slow play.

8. A golf information system of claim 6 wherein said golf clubhouse microprocessor means is used for automatic notification to a golf course ranger of slow play of said golfers.

9. A golf information system of claim 1 wherein said receiver comprises a global positioning satellite receiver whereby said position of said receiver is determined at least partially by signals received from a plurality of satellites.

10. A golf information system for providing a golfer with information regarding the distance to designated points on a golf course having a plurality of golf holes comprising:

a receiver moveable with said golfer having locating means for determining the position of said receiver on said golf course and microprocessing means for calculating distances from said position of said receiver to said designated points stored in a memory, said microprocessing means relaying said information to display means for displaying said information to said golfer regarding the distance to said designated points on said golf course relative to said receiver;

golf hole determination means for causing said display means to output said information related to one of said golf holes being played by said golfer wherein the golf course includes a plurality of golf hole identifying regions with at least one said hole identifying region associated with each said golf hole, such that said position of said receiver is compared with said hole identifying regions by said microprocessing means to detect the presence of said receiver within a hole identifying region on said golf course in order to automatically establish a present golf hole being played by said golfer, wherein once said present golf hole is established said information is related to said designated points of said golf course associated with said present golf hole until a new golf hole is automatically established by detecting the presence of said receiver within another of said hole identifying regions; and transmitter means movable with said golfer for transmitting said present golf hole being played by said golfer established by said golf hole determination means to a centralized golfer monitoring system.

11. A golf information system of claim 10 wherein said transmitter means further transmits said receiver position to said centralized golfer monitoring system.

12. A golf information system of claim 10 wherein said hole identifying regions include a region adjacent a tee box of one of said golf course holes to determine that said golfer is starting play on said present hole.

13. A golf information system of claim 10 wherein said hole identifying regions include a region adjacent a green of one of said golf course holes to determine that said golfer is completing play on said present hole.

14. A golf information system of claim 10 wherein said hole identifying regions are defined by the location of said golf information system relative to a waypoint on said golf course.

15. A golf information system for providing a golfer with information regarding the distance to designated points on a golf course having a plurality of golf holes comprising:

a receiver moveable with said golfer having a locating means for determining the position of said receiver on said golf course and microprocessing means for calculating distances from said position of said receiver to said designated points stored in a memory, said microprocessing means relaying said information to display means for displaying said information to said golfer regarding the distance to said designated points on said golf course relative to said receiver;

golf hole determination means for causing said display means to output said information related to one of said golf holes being played by said golfer wherein the golf course includes a plurality of golf hole identifying regions with at least one said hole identifying region associated with each said golf hole and at least two said hole identifying regions associated with one said golf hole, such that said position of said receiver is compared with said hole identifying regions by said microprocessing means to detect the presence of said receiver within a hole identifying region on said golf course in order to automatically establish a present golf hole being played by said golfer, wherein once said present golf hole is established said information is related to said designated points of said golf course associated with said present golf hole until a new golf hole is automatically established by detecting the presence of said receiver within another of said hole identifying regions; and transmitter means movable with said golfer for transmitting said present golf hole being played by said golfer established by said golf hole determination means to a centralized golfer monitoring system.

16. A golf information system of claim 15 wherein said transmitter means further transmits said receiver position to said centralized golfer monitoring system.

17. A golf information system of claim 15 wherein said hole identifying regions include a region adjacent a tee box of one of said golf course holes to determine that said golfer is starting play on said present hole.

18. A golf information system of claim 15 wherein said hole identifying regions include a region adjacent a green of one of said golf course holes to determine that said golfer is completing play on said present hole.

19. A golf information system of claim 15 wherein said hole identifying regions are defined by the location of said golf information system relative to a waypoint on said golf course.

20. A golf information system of claim 15 wherein said hole identifying regions include a region adjacent a tee box and a region adjacent a green of one of said golf course holes to determine when said golfer is starting or completing play on said golf course hole.

* * * * *